US006490731B1

(12) United States Patent
Hyatt

(10) Patent No.: US 6,490,731 B1
(45) Date of Patent: Dec. 10, 2002

(54) TRAVEL APRON

(76) Inventor: Dan A. Hyatt, 8340 NW. 113th Ter., Oklahoma City, OK (US) 73162

( * ) Notice: Subject to any disclaimer, the term of this patent is extended or adjusted under 35 U.S.C. 154(b) by 0 days.

(21) Appl. No.: 10/012,088

(22) Filed: Dec. 11, 2001

(51) Int. Cl.[7] ..... A41B 13/10
(52) U.S. Cl. ..... 2/49.1; 2/49.2; 2/49.4
(58) Field of Search ..... 2/49.1, 49.2, 49.4, 2/46, 48, 51

(56) References Cited

U.S. PATENT DOCUMENTS

| | | | | | |
|---|---|---|---|---|---|
| 797,434 | A | * | 8/1905 | Homeyer | 2/49.4 |
| 2,164,369 | A | | 7/1939 | Woolever | |
| 2,367,383 | A | * | 1/1945 | Tiscornia | 2/49.2 |
| 4,114,199 | A | * | 9/1978 | Malan | 2/49.2 |
| 4,779,288 | A | | 10/1988 | Mack | |
| D305,377 | S | | 1/1990 | Labatto | |
| D307,070 | S | | 4/1990 | Wymer | |
| 4,924,527 | A | * | 5/1990 | Hintermeyer | 2/49.2 |
| D311,445 | S | | 10/1990 | Dawahare | |
| 5,244,278 | A | * | 9/1993 | Robitaille | 2/49.2 |
| 5,457,820 | A | | 10/1995 | Yielding | |
| 5,490,289 | A | * | 2/1996 | Lehrer | 2/49.2 |
| 5,530,968 | A | | 7/1996 | Crockett | |
| 5,570,474 | A | * | 11/1996 | Berry et al. | 2/48 X |
| D387,723 | S | | 12/1997 | Holmes | |
| 5,778,450 | A | * | 7/1998 | Hagestad et al. | 2/49.3 |
| 5,802,610 | A | * | 9/1998 | Burr | 2/49.4 |
| 5,875,490 | A | | 3/1999 | Woodward | |
| 5,956,763 | A | | 9/1999 | Blackshear | |
| D415,334 | S | | 10/1999 | Nakamoto | |
| 5,960,472 | A | * | 10/1999 | Reid | 2/48 |
| D436,430 | S | | 1/2001 | Merrifield | |
| 6,334,220 | B1 | * | 1/2002 | Frye | 2/49.2 |

* cited by examiner

*Primary Examiner*—Gloria M. Hale
(74) *Attorney, Agent, or Firm*—Randal D. Homburg

(57) ABSTRACT

The invention is a reusable travel apron intended for use while seated in a vehicle, the travel apron providing a liquid and stain resistant cover for the passenger, the apron having a front liquid absorbing layer laminated to a liquid resisting layer, the apron having an absorbent sponge-filled outer periphery, a plurality of debris-catching pockets and fold-out pockets for containment of drinks, food items or travel accessories for children.

4 Claims, 3 Drawing Sheets

TRAVEL APRON

CROSS REFERENCE TO RELATED APPLICATIONS

None

BACKGROUND OF THE INVENTION

1. Field of Invention

The invention is a reusable travel apron intended for use while seated in a vehicle, the travel apron providing a liquid and stain resistant cover for the passenger, the apron having a front liquid absorbing layer laminated to a liquid resisting layer, the apron having an absorbent sponge-filled outer periphery, a plurality of debris-catching pockets and fold-out pockets for containment of drinks, food items or travel accessories for children.

2. Description of Prior Art

The following United States patents were discovered and are disclosed within this application for utility patent. All relate to aprons and bibs associated with travel.

Several design patents include travel bibs with what appears to be a variety of placed pockets, such patents including U.S. Pat. No. D 305,377 to Labatto, U.S. Pat. No. D 311,445 to Dawahare, U.S. Pat. No. D 307,070 to Wymer and U.S. Pat. No. D 436,430 to Merrifield. U.S. Pat. No. D 387,723 to Holmes indicates a contoured auto bib. U.S. Pat. No. D 415,334 to Nakamoto indicates a commuter bib with weights on a bottom periphery.

A bib with adhesive tabs is indicated in U.S. Pat. No. 5,956,763 to Blackshear, the bib having a central liquid catch pocket oriented between the legs of the wearer, the pocket including a reinforced wire to hold the pocket in a shape. An body bib is the subject of U.S. Pat. No. 5,457,820 to Yeilding, the device having leg segments attaching to the wearer or to the bar of a safety seat or stroller, the bib having a pocket for containing items. Disposable bibs are found in U.S. Pat. No. 5,530,968 to Crockett (contained in a rolled dispenser) and U.S. Pat. No. 5,875,490 to Woodward (contained in a rolled dispenser, doubling as a garbage bag, a being dispensed with a cleansing wipe sheet).

A reusable bib with a material-receiving pocket is disclosed in U.S. Pat. No. 4,779,288 to Mack, while a bib is disclosed in U.S. Pat. No. 2,164,369 to Woolever which has retracting pleated pockets or "crumb-catchers" across the front of the bib.

None of the above patents disclose the present invention, which is distinguished by its contoured configuration of components covering the entire seated form of the wearer, its laminated absorbent and resistant layers, the accessory pockets, and the heavy extra-absorbing outer periphery which has a sponge-filled inner cavity to absorb more than a casual drip or slight spill, with the device being rewashable for multiple reuse.

SUMMARY OF THE INVENTION

The primary objective of the invention is to provide a reusable contoured apron for wear by a traveler to prevent the soiling of clothing while traveling.

A second objective of the invention is to provide the device with a laminated layer of fabrics, the outer fabric being absorbent and the underlying fabric being impervious to liquid, with an extra-absorbent outer periphery having a weighted sponge-filled absorbent rim.

A third objective of the invention is to provide expanding pockets for insertion of drink cups, drawing items, food or other items the user might place in such pockets.

Another objective of the invention would be to provide the device with a simple means of applying the device to a seated user with considerations as to the limited space inside a vehicle. In this sense, a neck loop may be provided with an elastic gather, allowing the neck loop to be placed over the head of the wearer and removed without concern over a fastening system or a need for two-handed application.

DESCRIPTION OF THE DRAWINGS

The following drawings are submitted with this utility patent application.

DESCRIPTION OF THE PREFERRED EMBODIMENT

Figure 1:
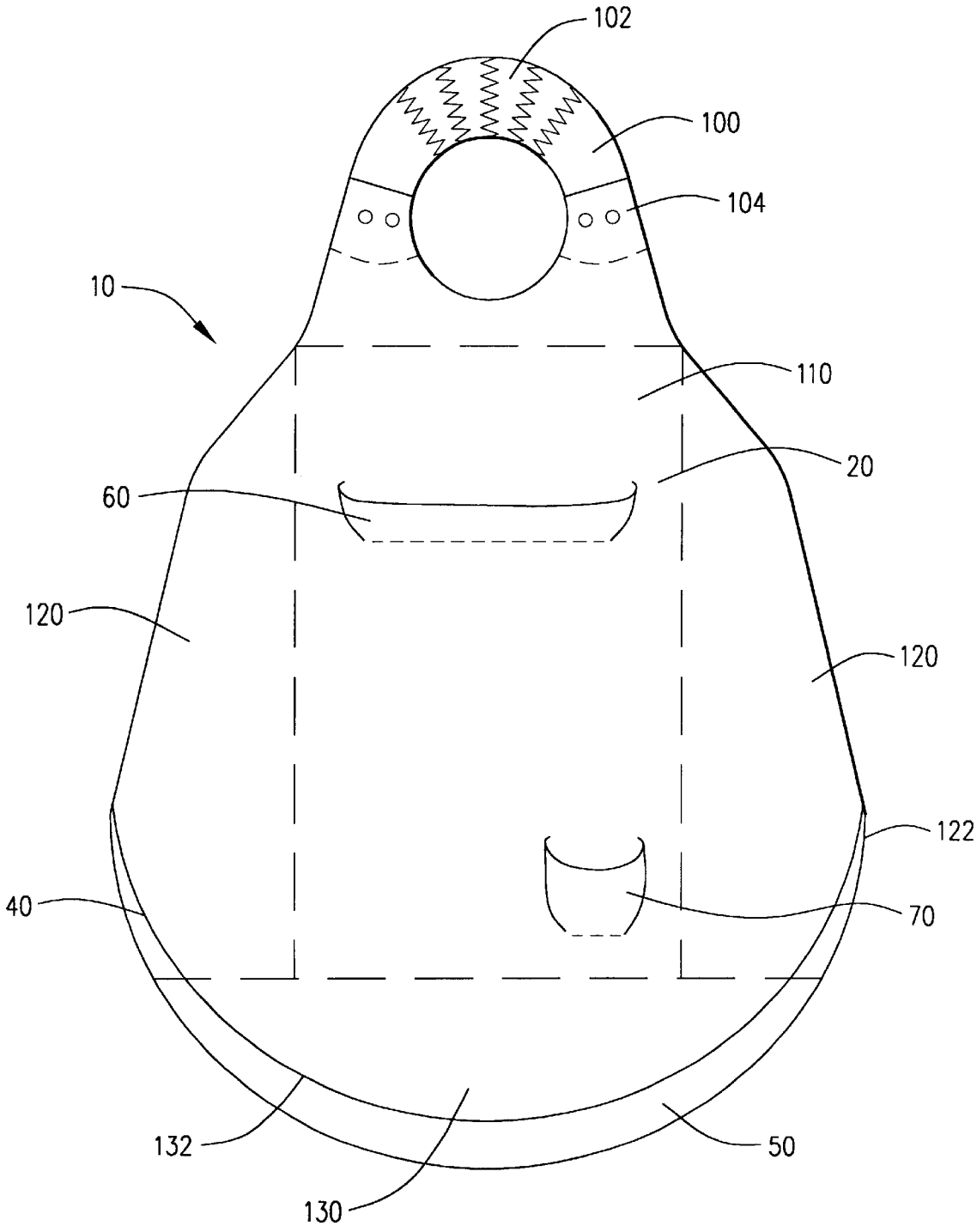
FIG. 1 is a front view of the device.

The invention, as shown in FIGS. 1–5 of the drawings, is a reusable travel apron intended for use by a person seated in a vehicle, the travel apron providing a liquid and stain resistant cover for the passenger, the travel apron 10 comprising essentially a front liquid absorbing fabric layer 20 laminated to a liquid impervious fabric layer 30, the travel apron 10 having an outer periphery 40 including a weighted sponge-filled absorbent rim 50. At least one debris-catching pocket 60 and at least one fold-out pocket 70 for containment of drinks, food items or travel accessories are attached to the front liquid absorbing fabric layer 20.

Figure 2:
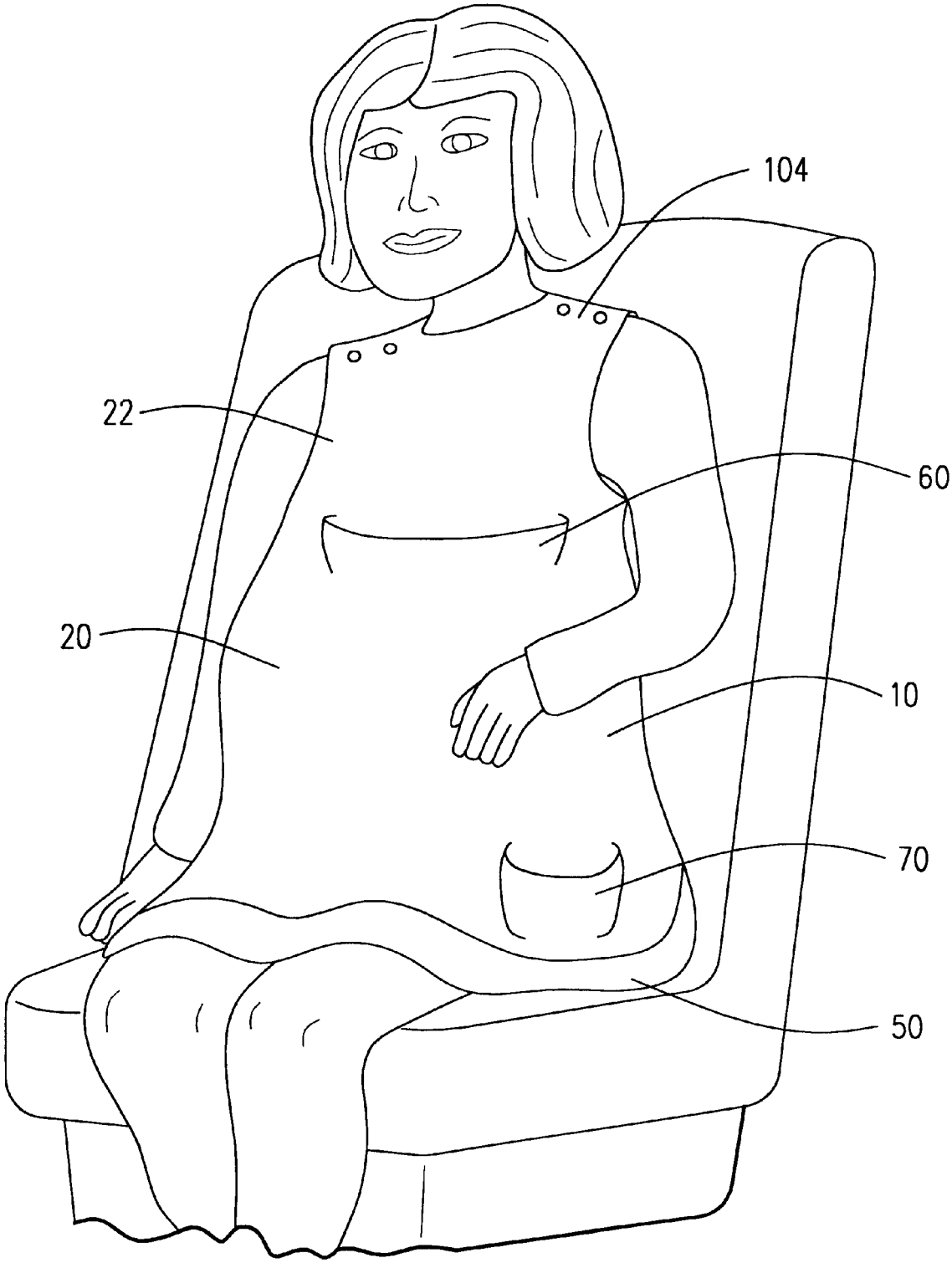
FIG. 2 is a view of the device on a vehicle occupant.

The travel apron 10, as shown in FIG. 1 of the drawings, has a neck loop 100, a front panel 110, contoured side panels 120 and a round tapering lap panel 130, wherein the travel apron 10, when worn, completely covers the entire front of a seated occupant wearer, with the outer periphery 40 resting evenly on the seat of the vehicle, as shown in FIG. 2 of the drawings. The neck loop 100 includes an elastic means 102 for holding the neck loop 100 securely around the neck of the user, while allowing for expansion to apply the travel apron over the head of the occupant wearer. The neck loop 100 also includes an adjustment means 104 to increase and decrease the fit to the wearer in order to maintain the outer periphery 40 to rest evenly on the seat of the vehicle.

Figure 4:
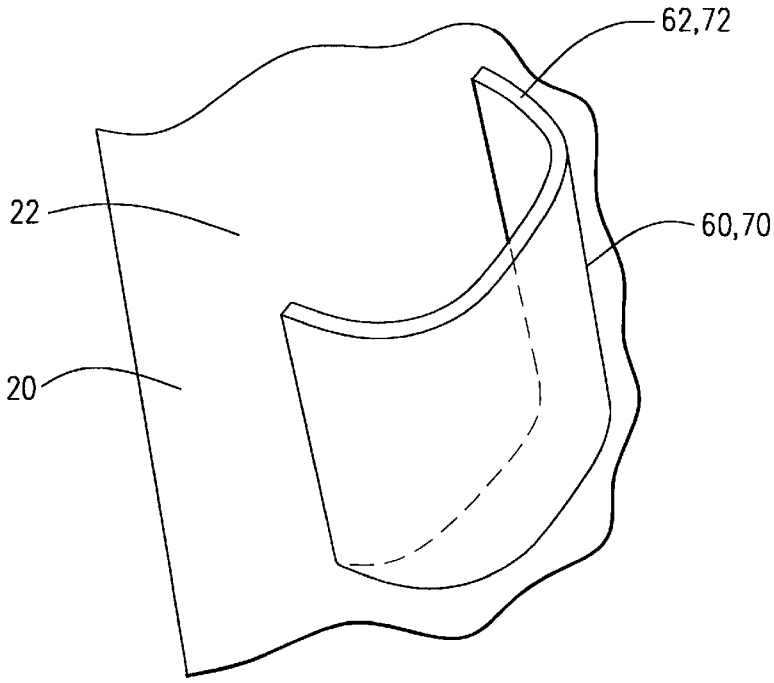
FIG. 4 is a view of an expanding pocket.

The front liquid absorbing fabric layer 20, as shown in FIGS. 2 and 4 of the drawings, has an outer surface 22, to which is attached at least one debris-catching pocket 60 and at least one fold-out pocket 70. In one embodiment, the debris-catching pocket 60 and the fold-out pocket 70 are permanently attached, while in a second embodiment, the debris-catching pocket 60 and the fold-out pocket 70 may be detachable. The debris-catching pocket 60 should be positioned below the neck loop 100 to catch debris which may be dropped by the user while eating or drinking. The fold-out pocket 70 is best positioned near the side panels 120 close to the lap panel 130 for access by the user to the contents placed in the fold-out pocket 70. The debris-catching pocket 60 and the fold-out pocket 70 may include a stiffening means 62, 72 to maintain a shaped fixed opening without collapse, such stiffening means 62, 72 including a resilient platic edge.

Figure 3:
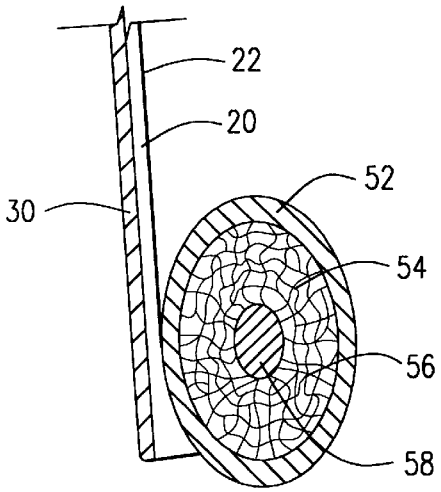
FIG. 3 is a cross section of the weighted sponge-filled absorbent rim on the outer periphery.
Figure 5:
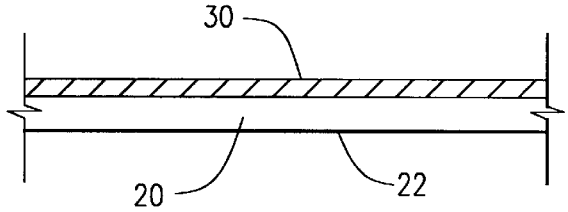
FIG. 5 is a side view of the laminated outer fabric layer and the underlying liquid impervious layer.

The weighted sponge-filled absorbent rim 50 is attached along the outer periphery 40 of the travel apron, specifically along an outer edge 122 of the contoured side panels 120 and along an outer edge 132 of the round tapering lap panel 130. The weighted sponge-filled absorbent rim 50 as shown in FIG. 3 of the drawings, includes a segment of absorbent cloth 52 forming a chamber 54 within which is contained an absorbent sponge material 56 having a high capacity of absorption and a weighted strand 58, preferably made of a non-corrosive metallic rope, within the weighted sponge-filled absorbent rim 50.

While the invention has been particularly shown and described with reference to a preferred embodiment thereof, it will be understood by those skilled in the art that changes in form and detail may be made therein without departing from the spirit and scope of the invention.

What is claimed is:

1. A reusable travel apron intended for use by a person seated in a vehicle, such travel apron providing a liquid and stain resistant cover for the passenger, the travel apron comprising essentially:

a front liquid absorbing fabric layer laminated to a liquid impervious fabric layer having an outer periphery to which is attached a weighted sponge-filled absorbent rim;

at least one debris-catching pocket attached to the front liquid absorbing fabric layer positioned to catch debris which may be dropped by the user while eating or drinking; and at least one fold-out pocket for containment of drinks, food items or travel accessories attached to the front liquid absorbing fabric layer positioned for access by the user to the contents placed in the fold-out pocket.

2. The travel apron, as disclosed in claim 1, further comprising:

a. the front liquid absorbing fabric layer laminated to the liquid impervious fabric layer having a neck loop, including an elastic means for holding the neck loop securely around the neck of the user, allowing for application of the travel apron over the head of the occupant wearer and an adjustment means to increase and decrease the fit of the travel apron to the wearer, positioning the outer periphery to rest evenly on a seat of the vehicle;

a front panel;

contoured side panels; and a round tapering lap panel, wherein the travel apron, when worn, completely covers the entire front of a seated occupant wearer, with the outer periphery resting evenly on the seat of the vehicle;

b. the front liquid absorbing fabric layer having an outer surface, to which is attached the debris-catching pocket and the fold-out pocket, c. the weighted sponge-filled absorbent rim having a length attached along the outer periphery of the travel apron, specifically along an outer edge of the contoured side panels and along an outer edge of the round tapering lap panel, such weighted sponge-filled absorbent rim including a segment of absorbent fabric forming a chamber within which is contained an absorbent sponge material having a high capacity of absorption and a weighted strand, filling the entire length of the weighted sponge-filled absorbent rim.

3. The travel apron, as disclosed in claim 2, wherein the debris-catching pocket and the fold-out pocket are permanently attached, such debris-catching pocket and fold-out pocket including a stiffening means to retain a shaped fixed opening without collapse.

4. The travel apron, as disclosed in claim 2, wherein the debris-catching pocket and the fold-out pocket are detachable, such debris-catching pocket and fold-out pocket including a stiffening means to retain a shaped fixed opening without collapse.

* * * * *